US012503829B2

(12) United States Patent
Vigneault

(10) Patent No.: US 12,503,829 B2
(45) Date of Patent: Dec. 23, 2025

(54) SCRAPING DEVICE FOR CLEANING A ROADWAY SURFACE

(71) Applicant: 9407-4895 Quebec Inc., Plessisville (CA)

(72) Inventor: Jimmy Vigneault, Plessisville (CA)

(73) Assignee: 9407-4895 Quebec Inc., Plessisville (CA)

( * ) Notice: Subject to any disclaimer, the term of this patent is extended or adjusted under 35 U.S.C. 154(b) by 0 days.

(21) Appl. No.: 18/622,028

(22) Filed: Mar. 29, 2024

(65) Prior Publication Data

US 2024/0240430 A1 Jul. 18, 2024

Related U.S. Application Data

(63) Continuation of application No. 17/532,551, filed on Nov. 22, 2021, now Pat. No. 11,946,220, which is a continuation of application No. 16/502,636, filed on Jul. 3, 2019, now Pat. No. 11,203,852, which is a continuation of application No. PCT/CA2018/050011, filed on Jan. 5, 2018.

(60) Provisional application No. 62/442,975, filed on Jan. 5, 2017.

(51) Int. Cl.

| | |
|---|---|
| ***E01H 5/06*** | (2006.01) |
| ***E01H 1/10*** | (2006.01) |
| ***E02F 3/76*** | (2006.01) |
| ***E02F 3/815*** | (2006.01) |

(52) U.S. Cl.

CPC ..... *E02F 3/8155* (2013.01); *E01H 1/105* (2013.01); *E02F 3/7627* (2013.01); *E02F 3/7631* (2013.01)

(58) Field of Classification Search

CPC ..... E01H 5/06; E01H 5/061; E01H 5/062; E01H 5/063; E01H 5/066; E01H 5/068; E01H 1/105; E01H 5/065; E01H 5/067; E02F 3/8155; E02F 3/7627; E02F 3/7631

See application file for complete search history.

(56) References Cited

U.S. PATENT DOCUMENTS

| | | | | |
|---|---|---|---|---|
| 1,406,325 A * | 2/1922 | Anderson | E02F 3/815 | 172/701.1 |
| 3,199,234 A * | 8/1965 | Reissinger | E01H 5/062 | 172/706 |
| 3,231,991 A * | 2/1966 | Wandscheer | E01H 5/065 | 37/232 |
| 3,845,870 A * | 11/1974 | Balderson | E02F 3/401 | 37/442 |
| 4,307,523 A * | 12/1981 | Reissinger | E01H 5/06 | 37/232 |

(Continued)

*Primary Examiner* — Edwin J Toledo-Duran

(74) *Attorney, Agent, or Firm* — Ziolkowski Patent Solutions Group, SC

(57) ABSTRACT

The device includes two opposing lateral wings forming the right and left sides of the scraping device. Each wing includes an upper section through which the wing is attached to the central support about a vertical pivot axis, and a bottom section that is pivotable with respect to the upper section about a first horizontal pivot axis. Each wing can follow the unevenness of the roadway surface and may also include parts that can pivot backwards in case of a frontal impact with an obstacle. The scraping device offers a very high degree of versatility and can clean various kinds of roadway surfaces with an unprecedented level of efficiency.

20 Claims, 11 Drawing Sheets

(56) References Cited

U.S. PATENT DOCUMENTS 4,574,502 A * 3/1986 Blau ..... E01H 5/065 172/747
4,643,261 A * 2/1987 Long ..... E02F 3/845 15/82
5,050,322 A * 9/1991 Burkard ..... E01H 5/068 37/270
5,140,763 A * 8/1992 Nichols, IV ..... E01H 5/062 37/270
5,148,617 A * 9/1992 Feller ..... E01H 5/067 37/231
5,344,254 A * 9/1994 Sartain ..... E01C 19/48 404/104
5,375,349 A * 12/1994 Jochim ..... E01H 5/065 37/409
D357,483 S * 4/1995 Ramsey ..... D15/32
5,477,600 A * 12/1995 Houle ..... E01H 5/065 172/823
5,485,690 A * 1/1996 MacQueen ..... E01H 5/06 172/395
5,568,694 A * 10/1996 Capra ..... E01H 5/06 37/231
5,638,618 A * 6/1997 Niemela ..... E01H 5/06 37/234
5,697,172 A * 12/1997 Verseef ..... E01H 5/062 172/264
5,720,122 A * 2/1998 McLellan ..... E01H 5/061 37/232
5,743,032 A * 4/1998 Vauhkonen ..... E01H 5/062 172/701.3
5,819,444 A * 10/1998 Desmarais ..... E01H 5/065 37/234
5,829,174 A * 11/1998 Hadler ..... E01H 5/06 37/234
5,899,007 A * 5/1999 Niemela ..... E01H 5/066 37/234
6,408,549 B1 * 6/2002 Quenzi ..... E01H 5/066 37/281
6,442,877 B1 * 9/2002 Quenzi ..... E01H 5/065 37/281
6,523,620 B1 * 2/2003 Burson ..... E01H 5/066 172/815
7,100,314 B1 * 9/2006 Jensen ..... E01H 5/066 37/231
7,171,770 B2 * 2/2007 Schultz ..... E01H 5/062 37/232
7,584,557 B1 * 9/2009 Nistler ..... E01H 5/065 37/234
7,712,233 B2 * 5/2010 Nesseth ..... E01C 19/203 37/409
7,743,536 B2 * 6/2010 Evans ..... E01H 5/06 37/231
7,762,014 B2 * 7/2010 Brock ..... E02F 3/401 37/444
8,776,405 B2 * 7/2014 Paonessa ..... E01H 5/062 37/232
9,051,700 B2 * 6/2015 Summers ..... E01H 5/063
9,200,418 B2 * 12/2015 Jones ..... E05D 3/02
9,255,371 B1 * 2/2016 Jordan ..... E01H 5/065
9,611,604 B2 * 4/2017 Vigneault ..... E01H 5/063
10,053,826 B1 * 8/2018 Null ..... E01H 5/067
10,480,140 B2 * 11/2019 Vigneault ..... E01H 5/062
10,508,408 B2 * 12/2019 Waters ..... E02F 3/7622
2003/0140528 A1 * 7/2003 Strait ..... E01H 5/06 37/266
2003/0221338 A1 * 12/2003 Verseef ..... E01H 5/062 37/266
2005/0019125 A1 * 1/2005 Panzarella ..... B60P 3/073 410/7
2006/0005435 A1 * 1/2006 Gamble ..... E01H 5/065 37/281
2006/0288616 A1 * 12/2006 Strait ..... E01H 5/063 37/231
2007/0068049 A1 * 3/2007 Quenzi ..... E01H 5/066 37/274
2007/0130806 A1 * 6/2007 Goodman ..... B66F 9/10 37/234
2007/0209240 A1 * 9/2007 Huehnergard ..... E01H 5/06 37/231
2008/0072464 A1 * 3/2008 Kost ..... E01H 5/066 37/231
2009/0282706 A1 * 11/2009 Barker ..... E01H 5/061 37/196
2009/0307944 A1 * 12/2009 Buckbee ..... E01H 5/066 37/266
2011/0011907 A1 * 1/2011 Panzarella ..... A61G 3/062 224/407
2011/0315411 A1 * 12/2011 Adams ..... A01B 73/02 172/311
2012/0279093 A1 * 11/2012 Niemela ..... E01H 5/061 37/242
2013/0067667 A1 * 3/2013 Hopkins ..... E01H 1/106 414/338
2013/0185962 A1 * 7/2013 Reeves ..... E01H 10/007 37/234
2013/0212912 A1 * 8/2013 Guggino ..... E02F 3/962 37/197
2013/0232827 A1 9/2013 Summers et al.
2015/0042071 A1 * 2/2015 Hamm ..... B60D 1/58 280/477
2015/0225914 A1 * 8/2015 Tykalsky ..... E01H 5/066 37/266
2016/0319503 A1 * 11/2016 Westman ..... B60Q 1/2657
2016/0375839 A1 * 12/2016 Weihl ..... E01H 5/061 37/231
2017/0089021 A1 * 3/2017 Sankovic ..... E01H 5/065
2017/0218585 A1 * 8/2017 Vigneault ..... E01H 5/062
2018/0127935 A1 * 5/2018 Paonessa ..... E01H 5/065
2018/0170280 A1 * 6/2018 Weihl ..... B60R 11/06
2018/0179730 A1 * 6/2018 Congdon ..... E02F 3/8152
2019/0016184 A1 * 1/2019 Billich ..... B60D 1/06
2019/0136474 A1 * 5/2019 Martin ..... E01H 5/062
2019/0203436 A1 * 7/2019 Martin ..... E01H 5/066
2019/0257057 A1 * 8/2019 Eckrote ..... E02F 3/7627
2019/0276999 A1 * 9/2019 Holman ..... E01H 5/062
2020/0114803 A1 * 4/2020 Horn ..... F21S 41/39
2021/0115645 A1 * 4/2021 Hrabarchuk ..... E02F 5/16
2021/0285171 A1 * 9/2021 Weihl ..... E01H 5/067
2022/0074154 A1 * 3/2022 Hoffman ..... E01H 5/065
2022/0136193 A1 * 5/2022 Weihl ..... E01H 5/067 37/232
2022/0243411 A1 * 8/2022 Vigneault ..... E01H 5/062
2023/0068800 A1 * 3/2023 Frey ..... E01H 5/062
2023/0366161 A1 * 11/2023 Bloch ..... E02F 3/8155

* cited by examiner

SCRAPING DEVICE FOR CLEANING A ROADWAY SURFACE

CROSS-REFERENCE TO PRIOR APPLICATIONS

The present case is a continuation of U.S. patent application Ser. No. 17/532,551, filed 22 Nov. 2021, itself a continuation of U.S. patent application Ser. No. 16/502,636 filed 3 Jul. 2019, now U.S. Pat. No. 11,203,852, itself a continuation of PCT Application No. PCT/CA2018/050011 filed 5 Jan. 2018. All these cases claim the benefits of U.S. patent application Ser. No. 62/442,975 filed 5 Jan. 2017. The entire contents of the prior patent applications are hereby incorporated by reference.

TECHNICAL FIELD

The technical field relates generally to scraping devices, more particularly to scraping devices for cleaning roadway surfaces, such as roadway surfaces covered with snow, ice, etc.

BACKGROUND

Numerous devices have been developed in the past to facilitate cleaning of surfaces that are at least partially covered with undesirable solid materials, liquid materials, or both, attached or not to these surfaces. However, there is always room for further improvements in this area of technology. Improvements in the overall efficiency of the cleaning are particularly desirable.

SUMMARY

According to one aspect, there is provided a scraping device for cleaning a roadway surface, the scraping device having a right side, a left side, and a lowermost edge and forming an overall front surface, the scraping device including a support and two opposing lateral wings forming the right and left sides of the scraping device, each wing extending in a lateral direction between an inner edge and an outer edge and having a front surface, the inner edge of each wing being configured to pivot about a vertical pivot axis that is shared with or distinct from the vertical axis of the other wing. Each wing includes an upper section through which the wing is attached to the vertical pivot axis, the upper section having a lowermost edge; a bottom section pivotable relative to the upper section about a first pivot axis, which first pivot axis is located at a position that is adjacent to the vertical pivot axis and also adjacent to the lowermost edge of the upper section, the upper and bottom sections of each wing being in a sliding engagement with one another; and a first force-generating mechanism comprising at least one compression spring mounted between the upper section and the bottom section to exert a first return force urging the bottom section downwards with reference to the upper section. The scraping device further includes at least one actuator mounted between the support and the upper section of each wing to pivot the wing about the vertical pivot axis.

According to another aspect, there is provided a scraping device for cleaning a roadway surface, the scraping device having a right side, a left side, and a lowermost edge, the scraping device including a support and two opposing lateral wings forming the right and left sides of the scraping device. Each wing extends in a lateral direction between an inner edge and an outer edge, and the inner edge of both wings is configured to pivot about a common vertical pivot axis. Each wing includes an upper section through which the wing is pivotally attached to the vertical pivot axis, the upper section having a lowermost edge and a bottom section pivotable relative to the upper section about a first pivot axis, which first pivot axis is located at a position that is adjacent to the vertical pivot axis and also adjacent to the lowermost edge of the upper section. The bottom section of each wing includes a first subsection through which the bottom section is pivotally attached to the upper section, the first subsection remaining parallel to a corresponding portion of the upper section when the bottom section is pivoted about the first pivot axis, the first subsection having a lowermost edge, and a second subsection positioned below the first subsection. Each wing also includes a first force-generating mechanism comprising at least one compression spring mounted between the upper section and the bottom section to exert a first return force urging the bottom section downwards with reference to the upper section. The scraping device additionally includes at least one actuator mounted between the support and the upper section of each wing to pivot the wing about the vertical pivot axis.

According to another aspect, there is provided a scraping device for cleaning a roadway surface, the scraping device having a right side, a left side, and a lowermost edge, the scraping device including a support having a front surface and two opposing lateral wings forming the right and left sides of the scraping device, each wing having an inner edge, an outer edge, and a front surface, the inner edge of each wing being configured to pivot about a corresponding vertical pivot axis provided on a respective lateral side of the support, the front surfaces of the support and that of the two opposing wings forming together a front surface of the scraping device. Each wing includes an upper section through which the wing is attached to the corresponding vertical pivot axis, the upper section having a lowermost edge; a bottom section pivotable relative to the upper section about a first pivot axis, which first pivot axis is located at a position that is adjacent to the vertical pivot axis and also adjacent to the lowermost edge of the upper section; and a first force-generating mechanism comprising at least one compression spring mounted between the upper section and the bottom section to exert a first return force urging the bottom section downwards with reference to the upper section. In addition, the scraping device includes at least one actuator mounted between the support and the upper section of each wing to pivot the wing about the corresponding vertical pivot axis.

Details of the various aspects of the proposed concept will become apparent upon reading the following detailed description and the appended figures to which reference is made.

DESCRIPTION

DETAILED DESCRIPTION

Figure 1:
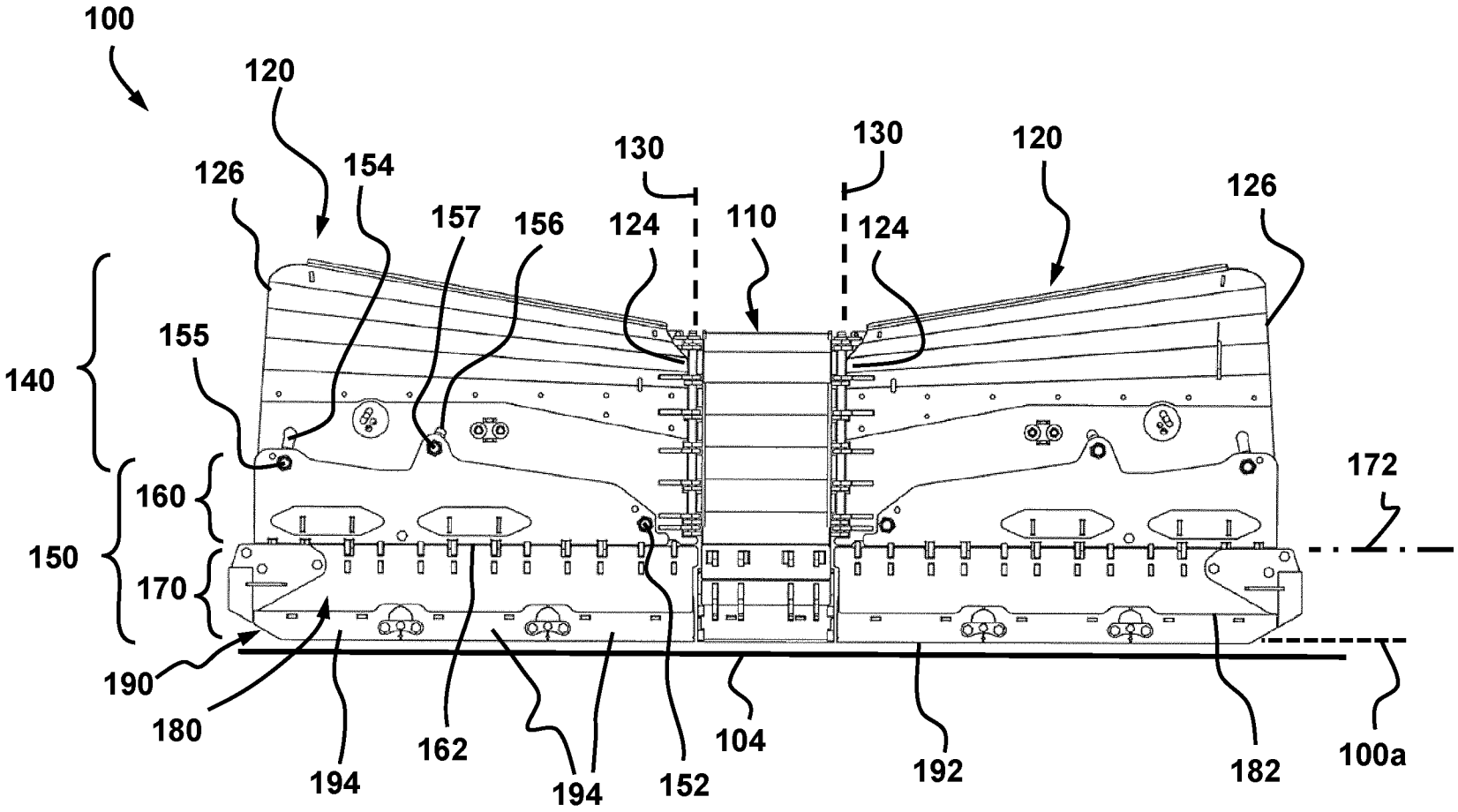
FIG. 1 is a front view of an example of a scraping device according to the proposed concept.

FIG. 1 is a front view of an example of a scraping device 100 according to the proposed concept. The scraping device 100 is adapted to be mounted at the front or at the rear of a vehicle, for example a truck, a tractor or any other suitable type of vehicle.

Figure 2:
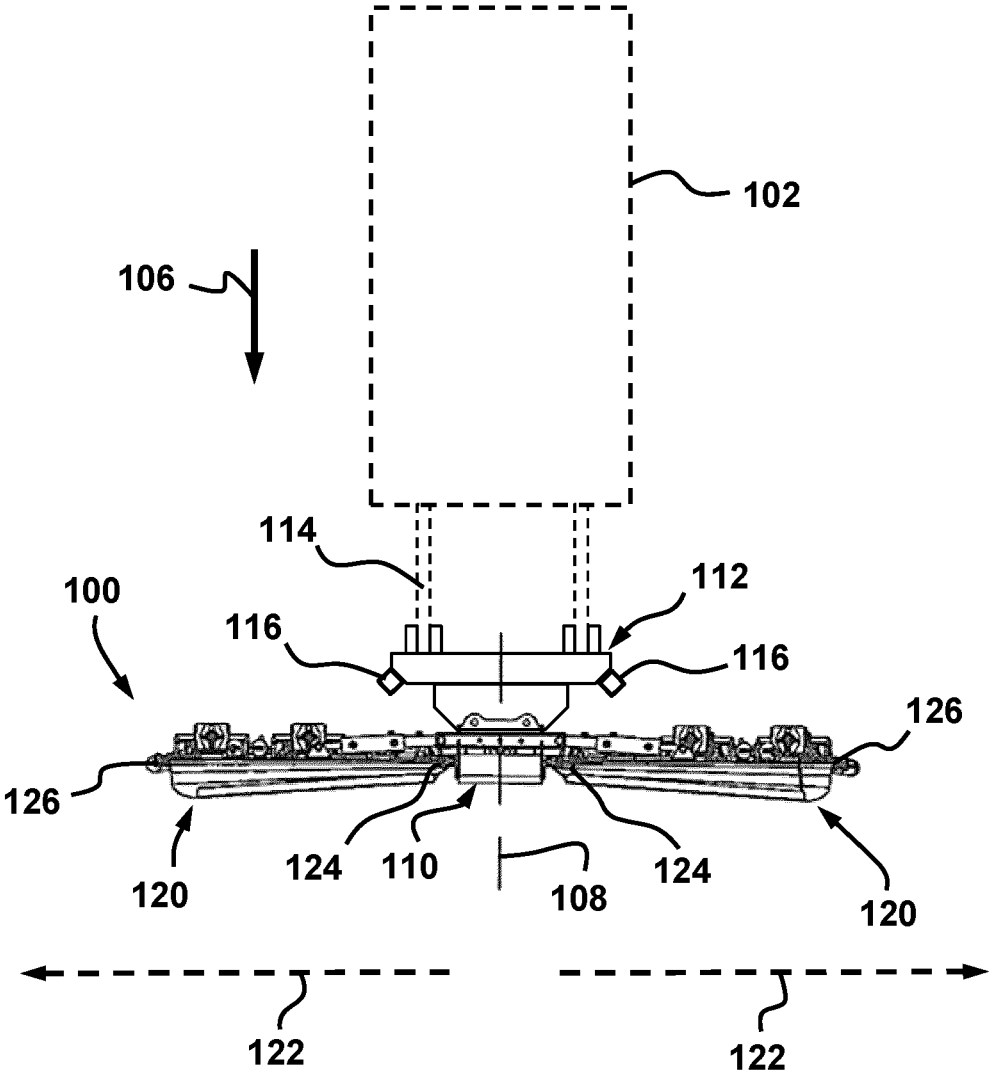
FIG. 2 is a semi-schematic top view of the scraping device illustrated in FIG. 1.
Figures 3A, 3B, 3C, 3D, 3E, 3F, 3G, 3H:
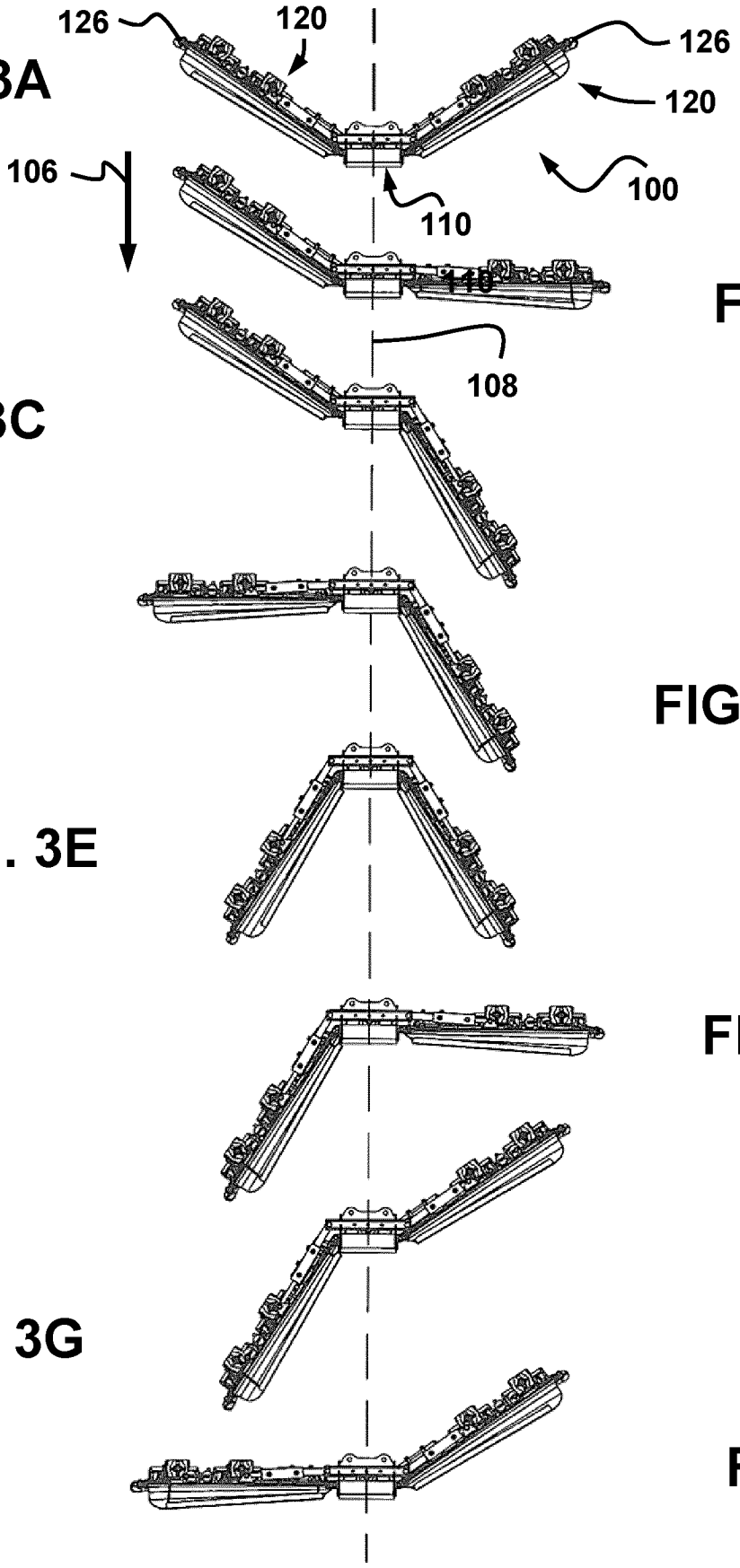
FIGS. 3A to 3H are top views showing examples of other wing orientations for the scraping device illustrated in FIGS. 1 and 2.

FIG. 2 is a semi-schematic top view of the scraping device 100 illustrated in FIG. 1. A generic vehicle is schematically depicted in FIG. 2 at 102.

This scraping device 100 is designed to clean a roadway surface 104, for example to clean, clear or otherwise remove materials such as snow and ice. The scraping device 100 can also be used to clean other kinds of materials, for example earth, mud, gravel, stones, waste, etc. The scraping device 100 engages the roadway surface 104 at a lowermost edge 100*a*. The lowermost edge 100*a* of the scraping device 100 is shown as being slightly above the roadway surface 104 in FIG. 1 for the sake of illustration.

It should be noted that the term "roadway surface" is used herein in a generic sense and generally refers to all the surfaces that can be cleaned by the scraping device 100. The roadway surface 104 may be the upper surface of a street or road but it can also be, for instance, a sidewalk, a parking lot, a pedestrian crossing, a commercial or residential driveway, etc. The roadway surface 104 could even be a surface that is not outdoors or be an unpaved surface. In the latter case, the unpaved surface on which travels the vehicle 102 carrying the scraping device 100 constitutes the roadway surface 104. Other variants are also possible.

The arrow 106 in FIG. 2 illustrates the forward direction of the scraping device 100 and the stippled line is the central longitudinal axis 108 of the scraping device 100. The forward and rearward directions of the scraping device 100 correspond to the forward and rearward directions of the vehicle 102, respectively, when the scraping device 100 is positioned at the front of the vehicle 102. However, the forward and rearward directions of the scraping device 100 correspond to the rearward and forward directions of the vehicle 102, respectively, when the scraping device 100 is positioned at the rear of the vehicle 102. Still, although the front surface of the scraping device 100 is the one designed to clean materials by pushing them, it is also possible to clean some of the materials using its rear side, namely the side opposite the one shown in FIG. 1, when the scraping device 100 travels in a rearward direction.

In the example illustrated in FIG. 1, the scraping device 100 includes a central support 110 and two opposite lateral wings 120. The two wings 120 form the right and left sides of the scraping device 100. They are substantially symmetrical in this example, but it is possible to design a scraping device 100 in which the right and left wings 120 are dissimilar in shape, length, etc.

The central support 110 in the example is significantly smaller in width than that of each of the wings 120. The width is about ⅓ of the width of each wing 120 but variants are possible. For instance, it can be from 1 to 90% of the average width of each wing 120, such as from 80 to 90%, or from 70 to 80%, or from 60 to 70%, or from 50 to 60%, or from 40 to 50%, or from 30 to 40%, or from 20 to 30%, or from 10 to 20%, or from 1 to 10% of the average width of each wing 120.

The central support 110 serves as a point of attachment to the vehicle 102 carrying the scraping device 100. As schematically shown in FIG. 2, the central support 110 can include a rear carriage 112 that is attached to the back of the front part of the central support 110 seen in FIG. 1, for instance using bolts or the like. The rear carriage 112 is affixed to the vehicle 102, for instance to the free end of an articulated boom 114 of the vehicle 102 that can move the whole scraping device 100 at least up and down with reference to the roadway surface 104 using one or more actuators. The rear carriage 112 can be taller, larger, or both, than the front part of the central support 110. It can also include at least one skid or wheel that engages the roadway surface 104 when the lowermost edge 100*a* is on the roadway surface 104, for instance to support a part of the overall weight. Other configurations and arrangements are possible as well.

Each wing 120 in the example generally extends in a lateral direction 122, between an inner edge 124 and an outer edge 126. It should be noted that the lateral direction 122 of the right wing 120 is diametrically opposite that of the left wing 120 when the wings 120 are perpendicular to the longitudinal axis 108, as shown in FIG. 2. The lateral directions 122 have a variable angle with reference to the longitudinal axis 108 during operation because the inner edge 124 of each wing 120 is pivotally attached to the central support 110. Each wing 120 pivots about a vertical pivot axis 130, as shown in FIG. 1. There are two vertical pivot axes 130 in the illustrated example that are substantially parallel to one another. Other configurations and arrangements are possible. For instance, it is possible to have a common single vertical pivot axis 130 for both wings 120.

FIGS. 3A to 3H are top views showing examples of other wing orientations for the scraping device 100 illustrated in FIGS. 1 and 2. As can be seen, the wings 120 can have many different orientations and these examples are just a few of the possibilities. Each wing 120 is independently orientable about the corresponding vertical pivot axis 130. They each can be positioned anywhere between a maximum rearward position and a maximum forward position. The range of angular positions is the same for the two wings 120 in the example, but it is also possible to have a different range between the right and left wings 120. Other configurations and arrangements are possible.

The rear carriage 112 in the example of FIG. 2 includes a pair of bumpers 116 on its outer front bottom ends. These bumpers 116 can be made of a resilient material and are oriented at an oblique angle with reference to the longitudinal axis 108. They are used as stoppers or cushions for each wing 120 when they are in their rearmost angular position. Other configurations and arrangements are possible. The bumpers 116 can also be omitted in some implementations.

The scraping device 100 forms what is sometimes called a V-blade or a V-plow in the technical field. It is particularly advantageous to clean areas that are sometimes narrow in width because the overall width of the scraping device 100 can be modified by changing the angular position of the wings 120 with reference to the longitudinal axis 108. The width can vary between a minimum width and a maximum width. The width is maximal when the wings 120 are perpendicular to the longitudinal axis 108, as shown in FIGS. 1 and 2.

The different possible orientations of the wings 120 also give many options to the operator on how the materials can be handled. For example, the operator may simply want to push the materials towards each side of the wings 120 as the scraping device 100 travels forward. The outer edges 126 of both wings 120 will then be positioned at the rear, as shown for instance in FIG. 3A. The outer edge 126 of the two wings 120 may also be positioned at the front, as shown for instance in FIG. 3E. This allows the accumulation of a relatively large quantity of materials in front of the scraping device 100 and to push these materials up to a given location. In other circumstances, one of the two wings 120 may be positioned at a non-perpendicular angular position while the other remains substantially perpendicular to the longitudinal axis 108, as shown for instance in FIGS. 3B, 3D, 3F and 3H, or both wings 120 may be at different opposite non-perpendicular angles, as shown for instance in FIGS. 3C and 3G.

Each wing 120 is an assembly of parts where some are movable relative to others. As shown in FIG. 1, each wing 120 in the illustrated example includes, among other things, an upper section 140 and a bottom section 150. Each of these upper sections 140 attaches the corresponding wing 120 to the central support 110. Each upper section 140 has a lowermost edge 142 (visible for instance in FIG. 5). The top of the bottom section 150 overlaps the lowermost edge 142 of the upper section 140 and is immediately in front of the upper section 140. The bottom section 150 is pivotable relative to the upper section 140 about a first horizontal pivot axis 152. Other configurations and arrangements are possible. For instance, the bottom section 150 can be positioned at the rear of the upper section 140 in some implementations. Other variants are also possible.

The first horizontal pivot axis 152 is a pivot that is adjacent to (i.e., not far from but still at least a few centimeters apart) the vertical pivot axis 130 of each wing 120. It is also adjacent to the lowermost edge 142 of the corresponding upper section 140. The bottom section 150 of each wing 120 pivots about the first horizontal pivot axis 152, between at least a bottom position and an upper position. The first horizontal pivot axis 152 is substantially perpendicular to the vertical pivot axis 130 in the example and the relative motion is purely a pivotal motion. Other configurations and arrangements are possible as well.

A guiding arrangement is provided on each wing 120 in the illustrated example. Two spaced-apart and arc-shaped guide slots 154, 156 are provided on each upper section 140 in the example. They cooperate with corresponding followers 155, 157 extending across these guide slots 154, 156 to keep the sections 140, 150 of each wing 120 in a sliding engagement with one another. They also limit the pivoting motion with reference to the first horizontal pivot axis 152. Annular washers 158, 159 are provided at the back of each upper section 140 to maintain the followers 155, 157 in position. The central follower 157 is attached to an upwardly projecting part in the example. Other configurations and arrangements are possible. For instance, the slots can be provided on the bottom section 150 in some implementations. Other kinds of guiding arrangements are possible. The guiding arrangements can be omitted in some implementations. Other variants are possible as well.

The bottom section 150 is itself an assembly of several parts in the example. In FIG. 1, each bottom section 150 includes, among other things, a first subsection 160 and a second subsection 170. The bottom section 150 is attached to the upper section 140 at the first subsection 160 so as to be pivotable about the first horizontal pivot axis 152. The first subsection 160 has a lowermost edge 162 and the second subsection 170 is positioned immediately below the lowermost edge 162 of the first subsection 160. The second subsection 170 can pivot with respect to the first subsection 160 about a second horizontal pivot axis 172, which generally extends along the lowermost edge 162 of the first subsection 160 in the example. As can be seen in FIG. 1, the second horizontal pivot axis 172 is vertically below the first horizontal pivot axis 152 and both are substantially perpendicular to one another. The second horizontal pivot axis 172 is also substantially perpendicular to the vertical pivot axis 130 in the example. Other configurations and arrangements are possible. It is possible to have a bottom section 150 that is a one-piece unit in some implementations. Other variants are possible as well.

In the illustrated example, the second subsection 170 includes, among other things, an upper portion 180 and a bottom portion 190. The second subsection 170 is attached to the first subsection 160 at the upper portion 180 so as to be pivotable about the second horizontal pivot axis 172. The upper portion 180 has a lowermost edge 182 and the bottom portion 190 is mainly extending below the lowermost edge 182 of the upper portion 180. The bottom portion 190 is designed to slide along the rear surface in the example. The front surface of the bottom portion 190 is slightly behind the rear surface of the upper portion 180 and can slide, although not necessarily in a linear motion, along the rear surface of the upper portion 180. The bottom portion 190 has a lowermost edge 192 defining a corresponding portion of the lowermost edge 100*a* of the scraping device 100. Other configurations and arrangements are possible. It is possible to have the rear surface of the bottom portion 190 in front of the upper portion 180 in some implementations. It is also possible to have a second subsection 170 that is a one-piece unit in some implementations. Other variants are possible as well.

Each bottom portion 190 can be subdivided into a plurality of juxtaposed segments 194. In the illustrated example, each wing 120 has three segments 194 but it is possible to provide a number of different segments 194, for instance two or more than three. The multiple segments 194 on each wing 120 are interconnected in the example by adjoining disks 196 and articulated links 198 located between adjacent segments 194. The segments 194 can then pivot with reference to one another to follow irregularities on the roadway surface 104. This arrangement is similar to the one described for instance in PCT patent application published on 21 Apr. 2016 under WO 2016/058106 A1. The entire contents of this publication are hereby incorporated by reference. Other configurations and arrangements are also possible. For instance, there is one where a plurality of independent discrete and juxtaposed small blades is provided. Such arrangement is described for instance in the Canadian Patent No. 2,796,157 issued on 13 Aug. 2013. The entire contents of this publication are also hereby incorporated by reference. Other variants are possible as well and having an undivided bottom portion 190 is possible.

Figure 4:
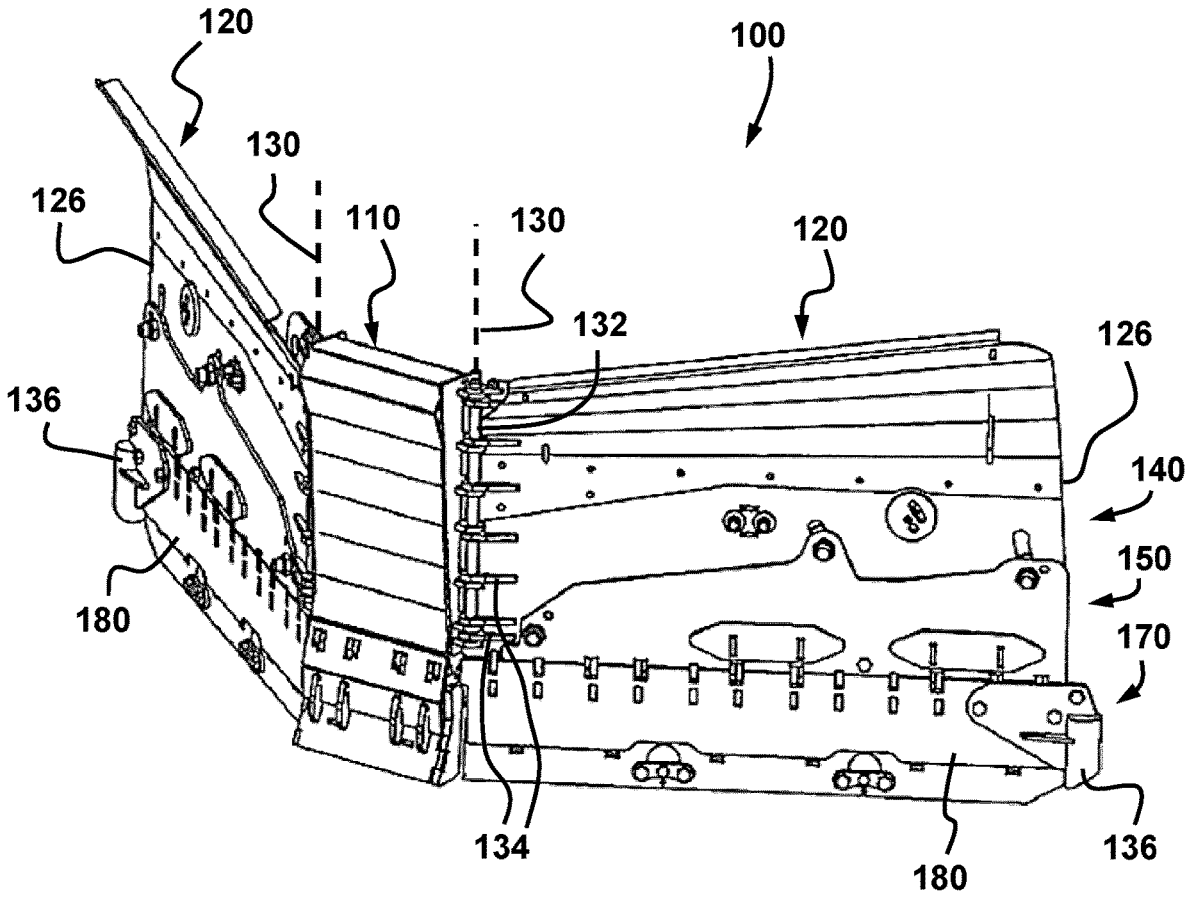
FIG. 4 is an isometric front view of the scraping device in FIG. 1 when the two wings are oriented slightly towards the rear.

FIG. 4 is a front isometric view of the scraping device 100 illustrated in FIG. 1 when the two wings 120 are oriented slightly towards the rear. As can be seen, each vertical pivot axis 130 around which a corresponding wing 120 pivots includes, in the example, an elongated rod 132 and a plurality of vertically spaced lateral hinge members 134 mounted to the elongated rod 132. Some of the hinge members 134 are affixed to the upper section 140 of the corresponding wing 120 while others are affixed to a corresponding lateral side of the central support 110. Other configurations and arrangements are also possible.

As can also be seen in FIG. 4, the outer bottom tip of each wing 120 includes a reinforcing sacrificial member 136 in the illustrated example. A portion of the reinforcing members 136 laterally extends beyond the outer edge 126 of the wings 120 in this example. These reinforcing members 136 are attached to the upper portion 180 of the corresponding second subsection 170. The reinforcing members 136 can be useful to solidify and protect the outer bottom tip of each wing 120 in case of an accidental or inadvertent impact with a structure like a curb or a wall. They are made easily removable in the example, for instance using bolts or other similar fasteners, to facilitate repairs or their replacement if they are damaged. They can also include an enlarged rounded side tip at their free end, as shown. Other configurations and arrangements are possible. The reinforcing members can be omitted in some implementations.

Figure 5:
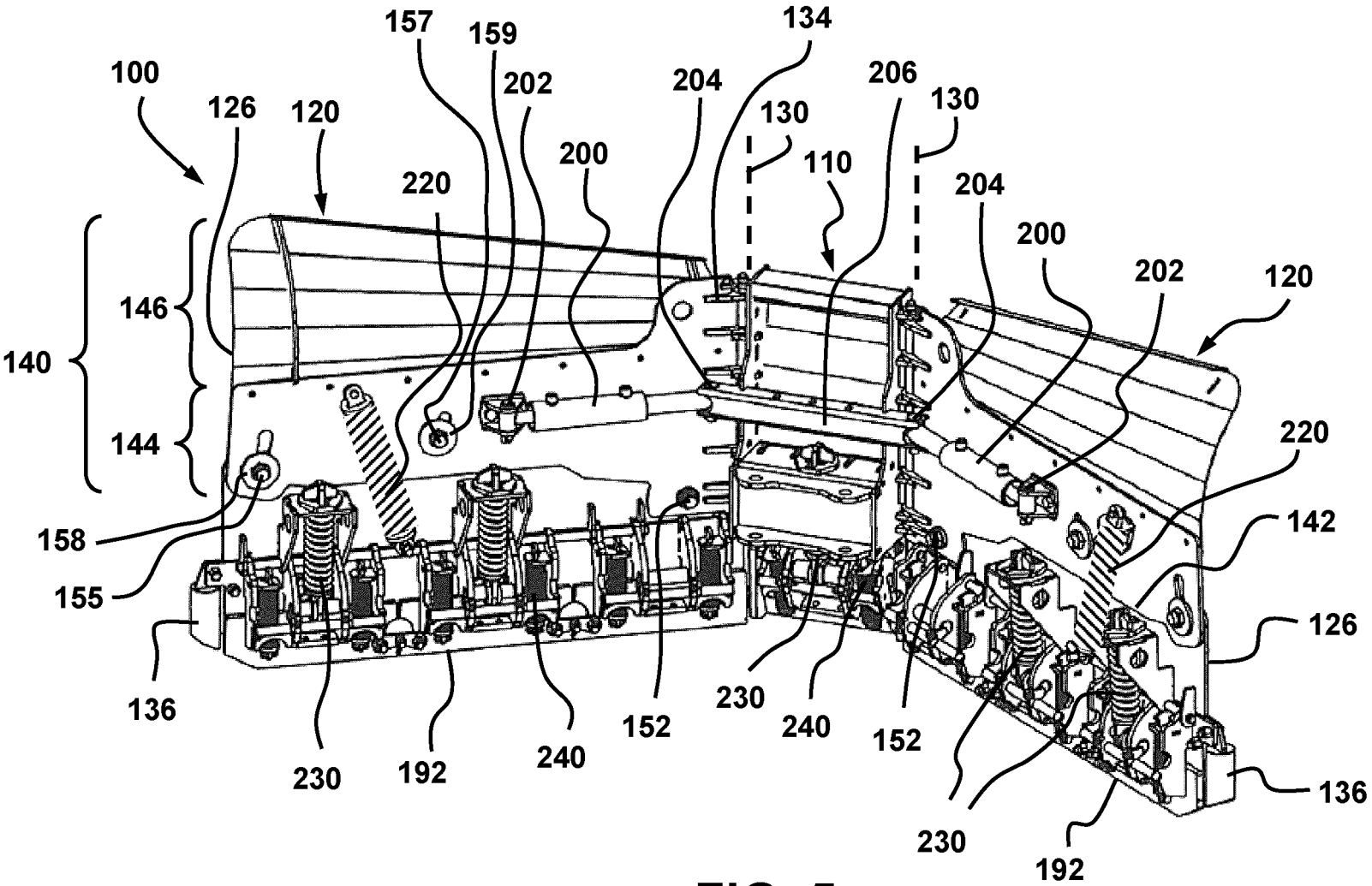
FIG. 5 is a rear isometric view of the example illustrated in FIG. 4.

FIG. 5 is a rear isometric view of the example illustrated in FIG. 4. It shows, among other things, the parts at the back of this version of the scraping device 100.

As can be seen in FIG. 5, the upper section 140 of each wing 120 in the illustrated scraping device 100 is made in two parts, namely a main bottom part 144 and an upper part 146. The main bottom part 144 holds the various attachment points and is designed to be very rigid so as to withstand the intense forces applied thereto during operation. The upper part 146 is only affixed over the main bottom part 144 and will not be subjected to the same level of forces during operation. It is designed differently so as to save weight and costs. For instance, the upper part 146 can be made of a lighter material than that of the main bottom part 144, or be made of a thinner sheet of the same material. The illustrated example has an upper part 146 made of a plurality of juxtaposed strips of a thinner sheet of material that are welded or otherwise affixed together. The upper part 146 is also curved towards the front. The curvature in some areas increases towards the top and towards the outer edges 126. Not all areas are curved in the example. Other configurations and arrangements are possible. The upper section 140 can even be made of a single part in some implementations, not include a curvature, or both. Other variants are possible as well.

Still, the main bottom part 144 of each wing 120 has a larger vertical width near the vertical pivot axis 130 than that of the distal part thereof in the illustrated example. It is substantially T-shaped. The lowermost edge 142 of the upper section 140 is thus not a straight line in the example. The hinge members 134 for the wings 120 are affixed to the main bottom part 144. Other configurations and arrangements are possible.

FIG. 5 further shows that there is at least one actuator 200 mounted between the central support 110 and the upper section 140 of each wing 120 to pivot the corresponding wing 120 around its vertical pivot axis 130. They allow the operator to control the angular position of each wing 120 from inside the vehicle 102, regardless of whether the vehicle 102 is moving or not. Each actuator 200 in the illustrated example is disposed substantially perpendicularly to the vertical pivot axis 130 and is positioned at the rear of the scraping device 100. They have one end pivotally attached to a corresponding outer pivot 202 located on the back of the upper section 140, and an opposite end pivotally attached to a corresponding inner pivot 204 located at one end of a horizontal beam 206 that is affixed to the back of the central support 110. The actuators 200 are hydraulic actuators but other kinds of actuators are possible in some implementations. Using more than one actuator per wing 120 is possible. Other configurations and arrangements are possible as well.

FIG. 5 also shows that each wing 120 of this example includes three force-generating mechanisms.

The first force-generating mechanism is associated with the angular positioning of the bottom section 150 with reference to the upper section 140 of each wing 120. In the illustrated example, the first force-generating mechanism includes at least one compression helical spring 220. This spring 220 mounted around a telescopic shaft extending between the upper section 140 and the first subsection 160 of the bottom section 150 of each wing 120. Each end of the telescopic shaft is attached to a corresponding pivot. The first force-generating mechanism allows exerting a first return force urging the bottom section 150 downwards around the first horizontal pivot axis 152. It also serves as a shock absorber. Other configurations and arrangements are possible. For instance, other types of force-generating mechanisms are possible, including pneumatic or hydraulic actuators. Other variants are also possible.

The second force-generating mechanism is associated with the positioning of the second subsection 170 with reference to the first subsection 160 of each wing 120 when the bottom section 150 has these two parts. In the illustrated example, the second force-generating mechanism of each wing 120 includes at least one compression helical spring 230 mounted between the first subsection 160 and the upper portion 180 of the second subsection 170. Each wing 120 includes two spaced-apart helical springs 230 in the example but variants are possible. The springs 230 exert a second return force so that the corresponding second subsection 170 always returns to a working position, namely a position where it is substantially parallel to the first subsection 160, following an impact with an obstacle on the roadway surface 104 that forced the whole second subsection 170 to pivot about the second horizontal pivot axis 172. The springs 230 also maintain the second subsections 170 in their working position. Other configurations and arrangements are possible. For instance, other types of force-generating mechanisms are possible in some implementations, including pneumatic or hydraulic actuators. Also, although the second subsections 170 of each wing 120 is a one-piece unit across the width of the wing 120, it is possible in some implementations to subdivide it in two or more discrete sections. Other variants are possible as well.

An obstacle can be defined as something on the roadway surface 104 that the lowermost edge 192 will strike in a frontal impact when moving in a forward direction 106 (FIG. 2). When this occurs, the second subsection 170 of each wing 120 will pivot backwards around the second horizontal pivot axis 172 to clear the obstacle and alleviate damages. An example of an obstacle is the upper rim of a manhole that abnormally protrudes upwards from the roadway surface 104, or the edge of a curb that the operator may not have seen. Several other types of obstacles exist.

The third force-generating mechanism is associated with the positioning of the segments 194 when the second subsection 170 is not a one-piece unit. In the illustrated example, the third force-generating mechanism of each wing 120 includes at least one compression helical spring 240 mounted between the upper portion 180 and the bottom portion 190 of the second subsection 170. Each wing 120 includes two spaced-apart helical springs 240 for each segment 194 in the example but variants are possible. The springs 240 generate a third return force urging the segments 194 of the bottom portion 190 downwards so that they follow the irregularities of the roadway surface 104, thereby fine-tuning the quality of the cleaning. Other configurations and arrangements are possible. For instance, other types of force-generating mechanisms are possible in some implementations, including pneumatic or hydraulic actuators. Other variants are possible as well.

An irregularity is a variation in height of the roadway surface 104 that is not an obstacle, i.e., a change on the roadway surface 104 that does not result in a frontal impact with the scraping device 100. An irregularity occurs within about the width of a wing 120, namely between the inner edge 124 and the outer edge 126 thereof. Other situations exist as well.

Figure 6:
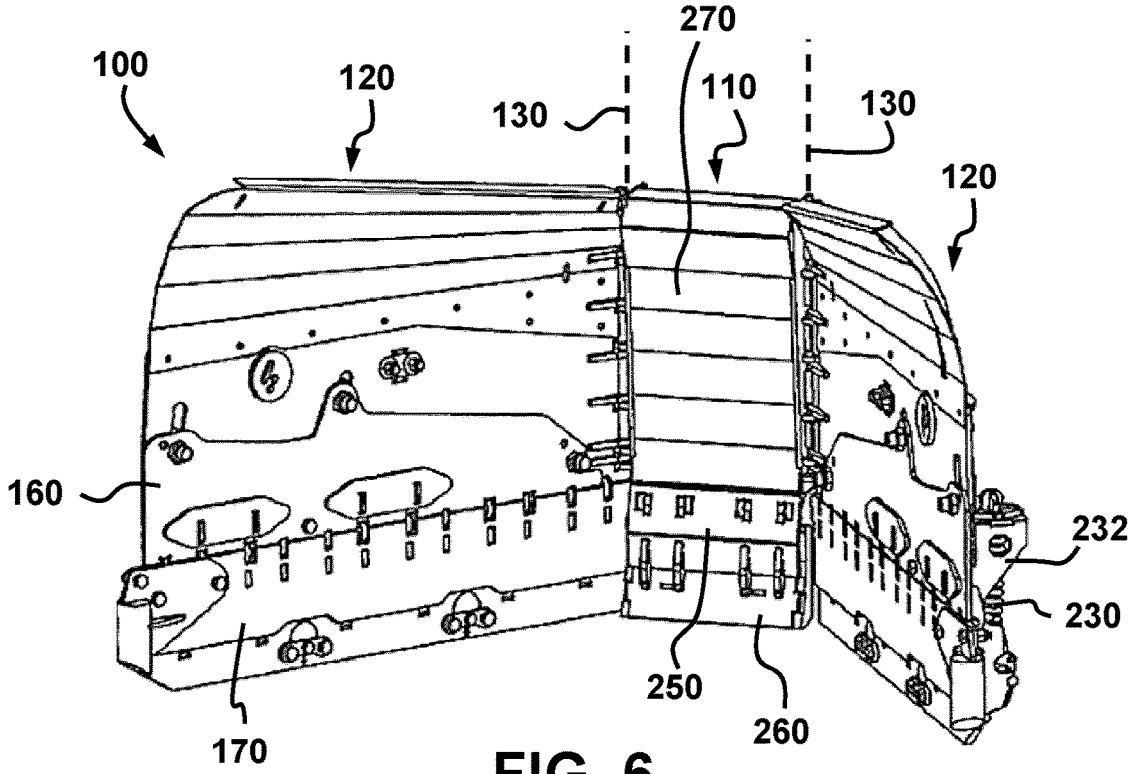
FIG. 6 is a view similar to FIG. 4 but in which the wings are now oriented towards the front.
Figure 7:
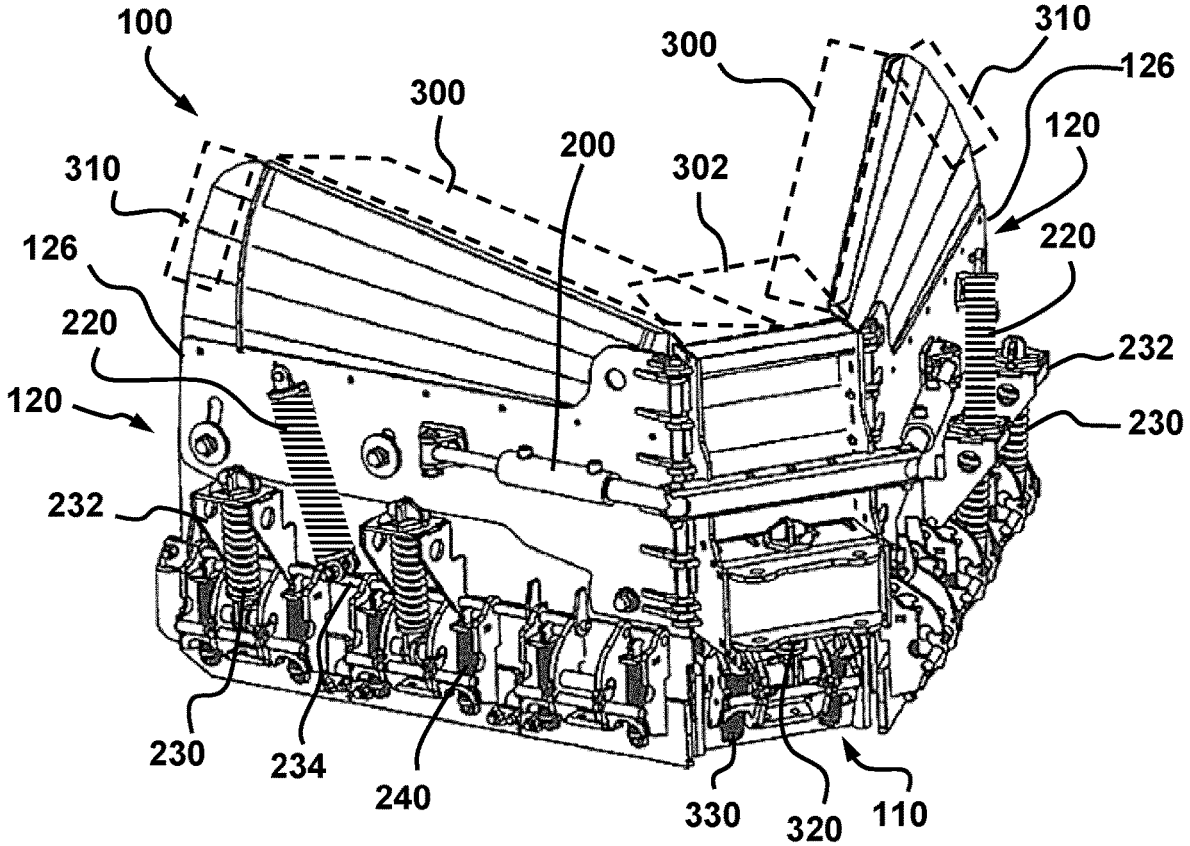
FIG. 7 is a rear isometric view of the example illustrated in FIG. 6.

FIG. 6 is a view similar to FIG. 4 but in which the wings 120 of the scraping device 100 are now oriented towards the front. FIG. 7 is a rear isometric view of the example illustrated in FIG. 6.

FIGS. 6 and 7 show, among other things, that the upper end of each spring 230 is mounted into the upper part of an upper bracket 232 in the illustrated example. The upper bracket 232 is affixed to the first subsection 160. The shaft 234 defines the second horizontal pivot axis 172 of each wing 120 and the bottom end of each spring 230 is pivotally mounted to a corresponding bottom bracket 236. Other configurations and arrangements are possible.

As can be seen, the bottom of the central support 110 in the illustrated example has a construction similar to that of the second subsection 170 of the wings 120. It includes an upper portion 250 and a bottom portion 260. The upper portion 250 is pivotable about a horizontal pivot axis that is substantially at the same height as that of the second horizontal pivot axis 172 of each wing 120. The bottom portion 260 is also designed to move in a substantially vertical movement relative to the upper portion 250. The bottom portion 260 has a lowermost edge 262 forming a corresponding portion of the lowermost edge 100*a* of the scraping device 100. Other configurations and arrangements are possible.

FIG. 7 shows that the central support 110 can itself include two force-generating mechanisms. In the illustrated example, there is at least one compression helical spring 320 that is similar to the springs 230, and at least one compression helical spring 330, in this case two spaced-apart compression helical springs 330, cooperating with the bottom portion 260. The springs 330 are similar to the springs 240. Other configurations and arrangements are possible. For instance, other types of force-generating mechanisms are possible, including pneumatic or hydraulic actuators. Other variants are possible as well. It is possible to omit one or both features in some implementations.

The central support 110 in this example provides a front surface 270 that is part of the overall front surface of the scraping device 100. Nevertheless, the front surface 270 can be absent in some implementations, for instance when the central support 110 is entirely located at the back. Other configurations and arrangements are also possible.

If desired, one can also affix a band of a flexible material on the top edge of the upper part 146 and of the central support 110. These bands are schematically depicted in FIG. 7 at 300, 302. The flexible bands 300, 302 can be useful for preventing at least some of the scraped materials from getting over the top edges, for instance when the scraping device 100 travels at a relatively high speed or during windy conditions. Other configurations and arrangements are possible. The bands can be omitted in some implementations.

Still, if desired, a strip of a resilient material can be attached to each lateral side of the wings 120. Lateral strips are schematically depicted in FIG. 7 at 310. They project laterally from the corresponding outer edge 126 of the upper section 140. They can be useful to mitigate damages in case of an accidental or inadvertent contact with an object, for instance a wall. Other configurations and arrangements are possible. The lateral strips can be omitted in some implementations.

Figure 8:
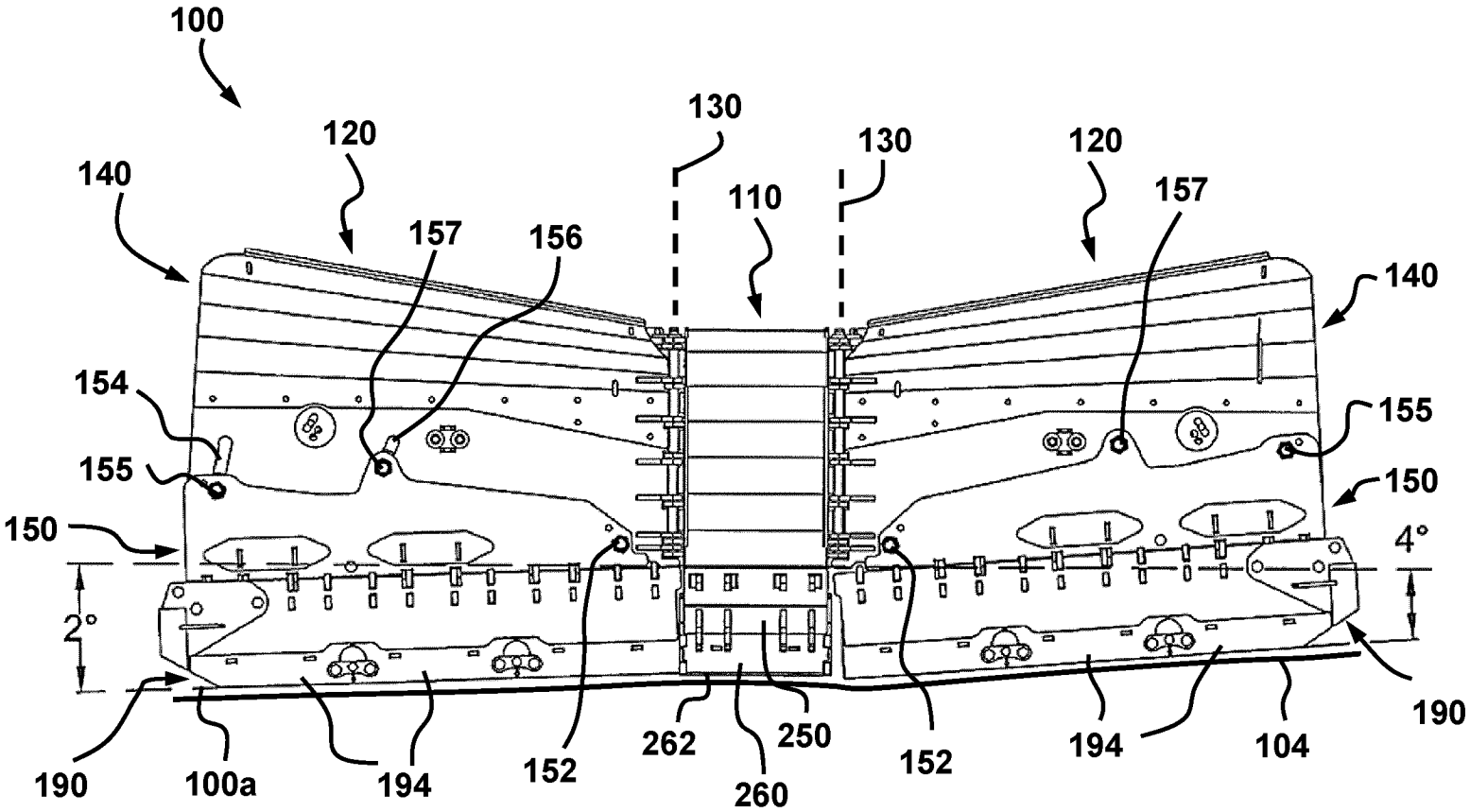
FIG. 8 is a front view showing an example of a situation where the scraping device in FIG. 1 is used on an uneven roadway surface.

FIG. 8 is a front view showing an example of a situation where the scraping device 100 in FIG. 1 is used on an uneven roadway surface 104. In this example, the roadway surface 104 has a variable inclination along the length of the lowermost edge 100*a* of the scraping device 100. The lowermost edge 100*a* of the scraping device 100 is shown as being slightly above the roadway surface 104 in FIG. 8 for the sake of illustration.

As can be seen in FIG. 8, the average angle defined by the roadway surface 104 under the right wing 120 (at the left in FIG. 8) with reference to the horizontal is not the same as the one under the left wing 120. This dissimilar inclination is referred to as unevenness. The central support 110 itself can be at another angle depending on the roadway surface 104 under the vehicle 102. There is an angular difference of 2 degrees under the right wing 120 (at the left in FIG. 8) and of 4 degrees under the left wing 120. These values are only examples, but they demonstrate a typical situation where the angles are uneven as often found in many locations. This may be because a paved surface is shaped to optimize the drainage of rainwater or because there are important height differences to compensate in a small space. Even if the roadway surface 104 is relatively regular in shape along the length of each wing 120, as in FIG. 8, its unevenness would have created challenges for the operator using a scraping device devoid of wings with a bottom section that can pivot about a horizontal pivot axis with reference to a corresponding upper section and multiple passes would probably be required to clean materials following a transversal direction with reference to the direction of the inclination. However, with the scraping device 100 based on the proposed concept, the unevenness of the roadway surface 104 can be compensated and the quality of the cleaning is increased.

If desired, one can include a horizontal protection bar at the back of each wing 120.

Figure 9:
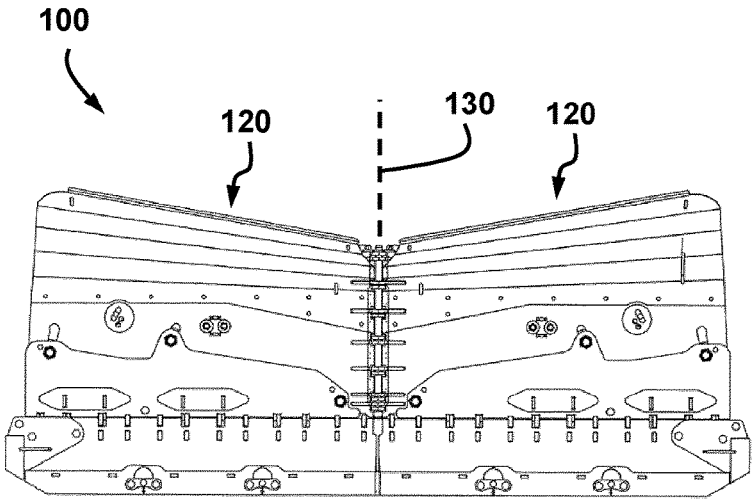
FIG. 9 is a front view of another example of a scraping device according to the proposed concept.

FIG. 9 is a front view of another example of a scraping device 100 according to the proposed concept. In this example, the two wings 120 are mounted around the same vertical pivot axis 130. The central support 110 is entirely at the rear and has no visible surface at the front but it still supports the wings 120 through the vertical pivot axis 130.

It otherwise includes the same features as in the example illustrated in FIG. 1. Other configurations and arrangements are possible.

Figure 10:
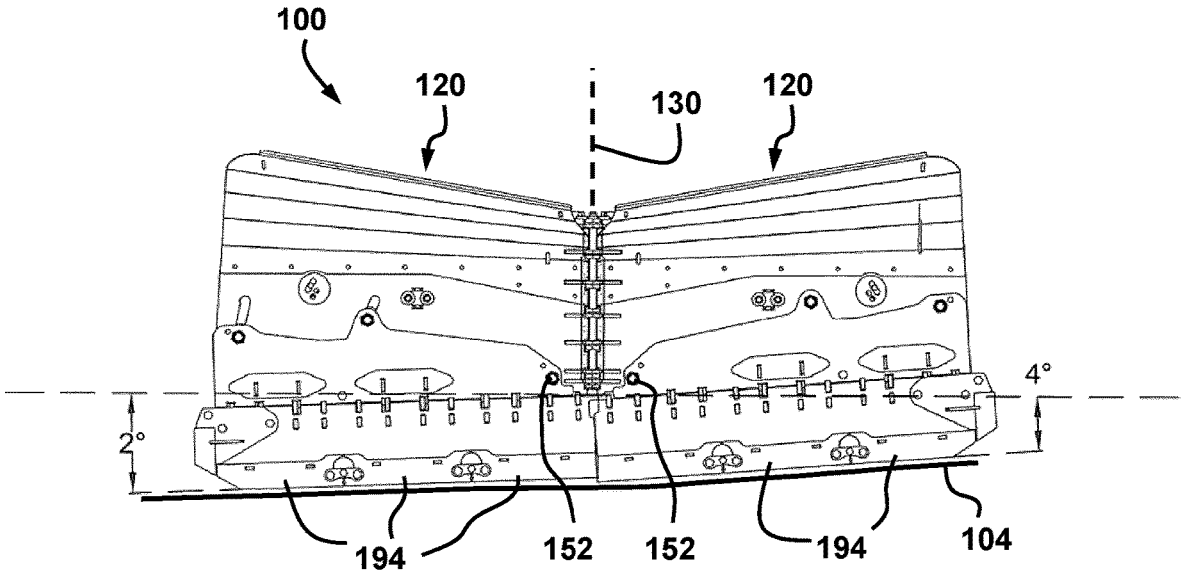
FIG. 10 is a front view showing an example of a situation where the scraping device in FIG. 9 is used on an uneven roadway surface.

FIG. 10 is a front view showing an example of a situation where the scraping device 100 in FIG. 9 is used on an uneven roadway surface 104. The lowermost edge 100*a* of the scraping device 100 is shown as being slightly above the roadway surface 104 in FIG. 10 for the sake of illustration. The operation is somewhat similar to that of the example illustrated in FIG. 8. The second subsections 170 are configured and disposed not to interfere with one another at their inner edge.

Figure 11:
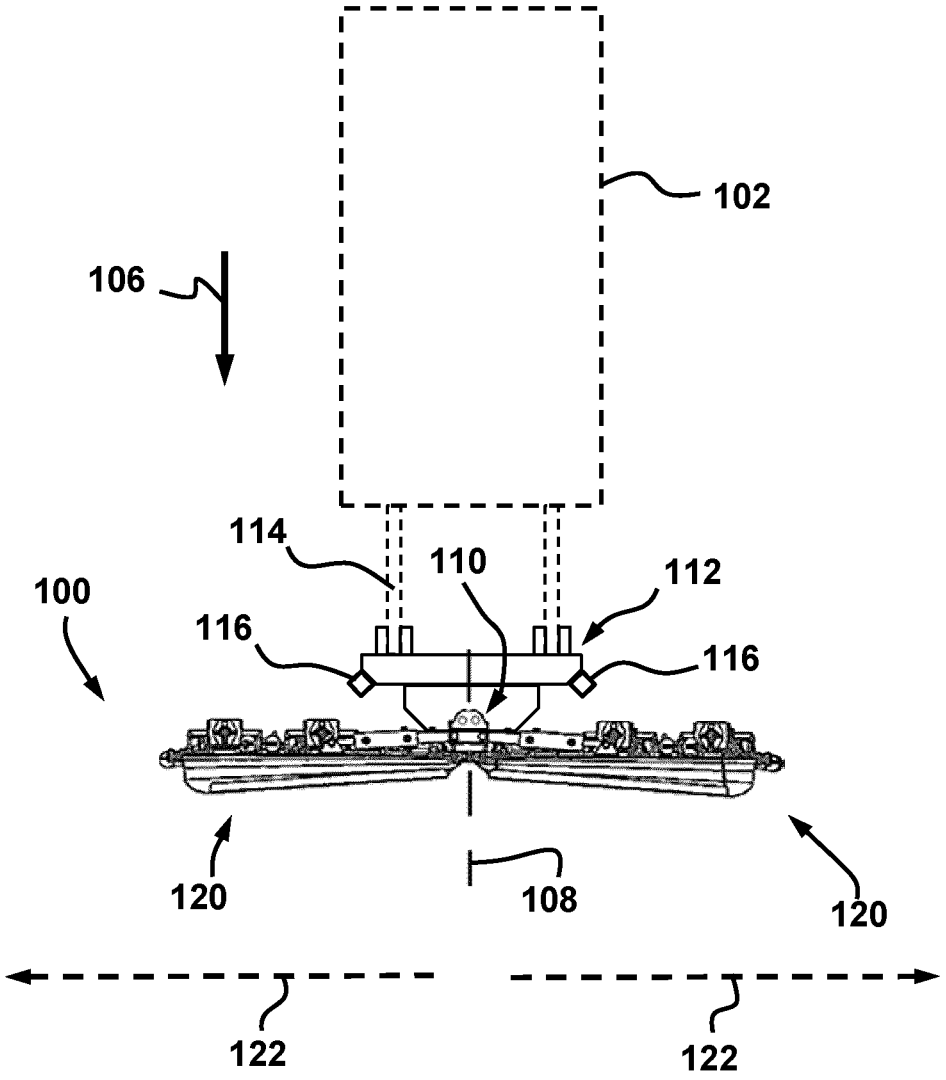
FIG. 11 is a semi-schematic top view of the scraping device illustrated in FIG. 9.

FIG. 11 is a semi-schematic top view of the scraping device 100 illustrated in FIG. 9. As can be seen, the central support 110 is entirely located at the back.

Figure 12:
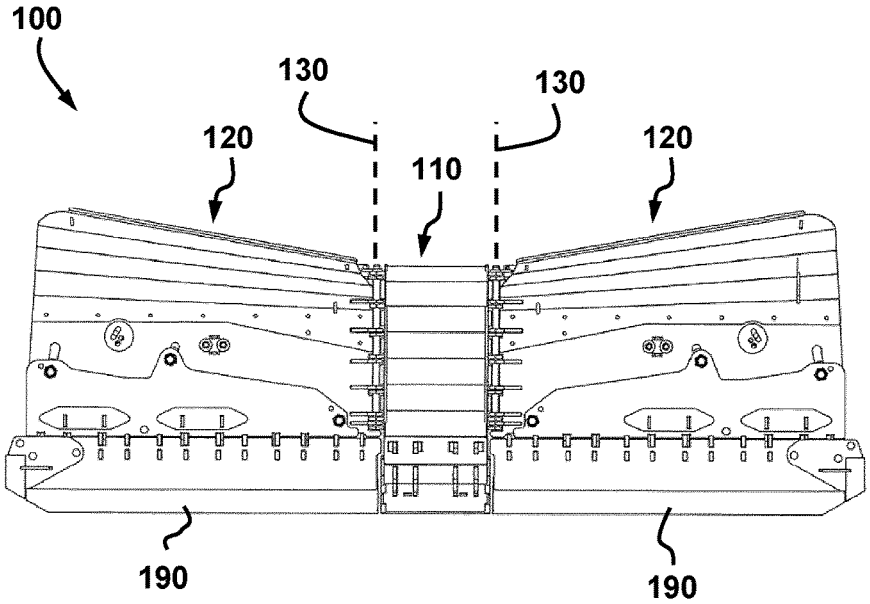
FIG. 12 is a front view of another example of a scraping device according to the proposed concept.

FIG. 12 is a front view of another example of a scraping device 100 according to the proposed concept. This example is similar to that of FIG. 1 but the bottom portion 190 is not subdivided in a plurality of segments. The single segment can still pivot with reference to the rest of the wing 120.

Figure 13:
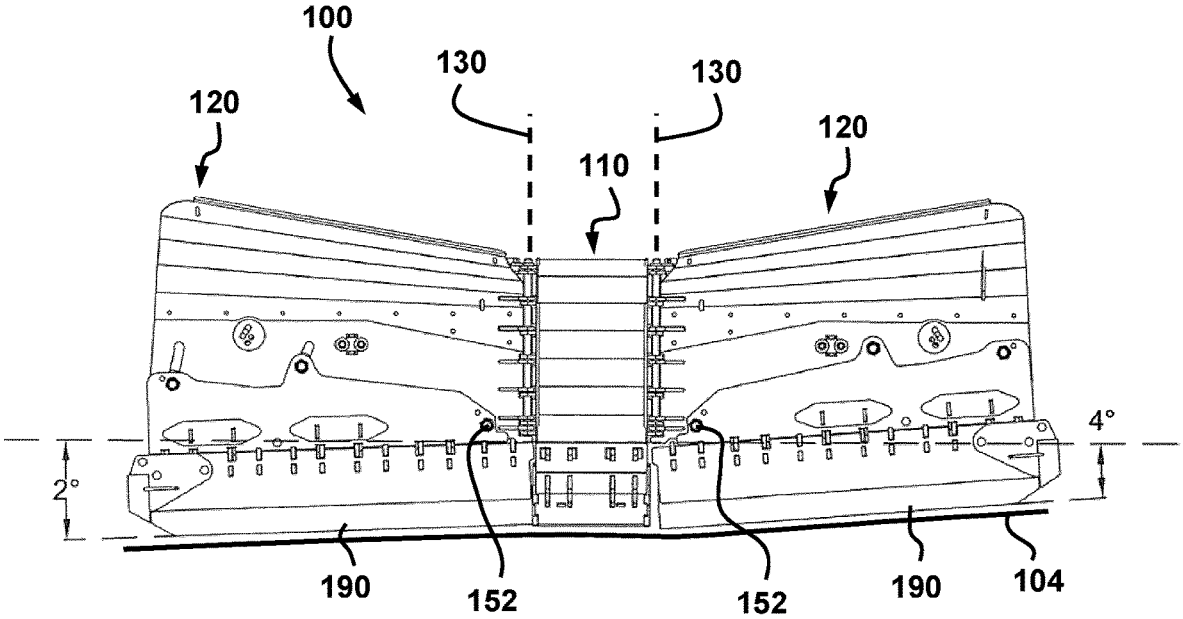
FIG. 13 is a front view showing an example of a situation where the scraping device in FIG. 12 is used on an uneven roadway surface.

FIG. 13 is a front view showing an example of a situation where the scraping device 100 in FIG. 12 is used on an uneven roadway surface 104. The lowermost edge 100*a* of the scraping device 100 is shown as being slightly above the roadway surface 104 in FIG. 13 for the sake of illustration. The operation is somewhat similar to that of the example illustrated in FIG. 8.

Figure 14:
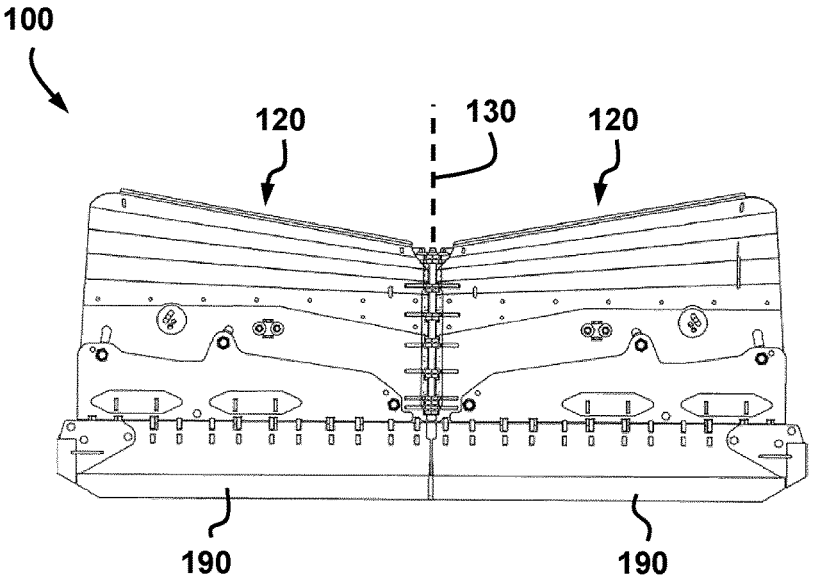
FIG. 14 is a front view of another example of a scraping device according to the proposed concept.

FIG. 14 is a front view of another example of a scraping device 100 according to the proposed concept. This example is similar to that of FIG. 9 but the bottom portion 190 is not subdivided in a plurality of segments. The single segment can still pivot with reference to the rest of the wing 120.

Figure 15:
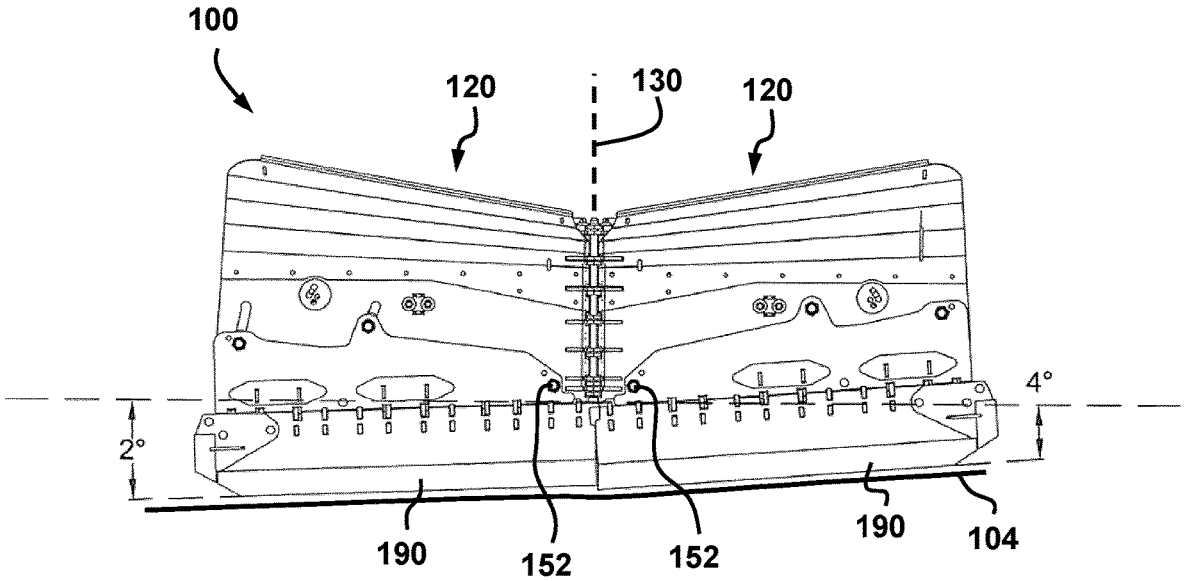
FIG. 15 is a front view showing an example of a situation where the scraping device in FIG. 14 is used on an uneven roadway surface.

FIG. 15 is a front view showing an example of a situation where the scraping device 100 in FIG. 14 is used on an uneven roadway surface 104. The lowermost edge 100*a* of the scraping device 100 is shown as being slightly above the roadway surface 104 in FIG. 15 for the sake of illustration. The operation is somewhat similar to that of the example illustrated in FIG. 8.

As can be appreciated, the scraping device 100 offers a very high degree of versatility and can clean various kinds of roadway surfaces with an unprecedented level of efficiency.

It should be noted that what is described in this detailed description and illustrated in the accompanying figures is only by way of example only. A person skilled in the related art will know from reading the description and viewing the figures that variants can be made while still remaining within the limits of the proposed concept.

LIST OF REFERENCE NUMBERS

100 scraping device
100*a* lowermost edge
104 roadway surface
106 main direction of movement
108 longitudinal axis
110 central support
112 rear carriage (of the central support)
114 boom
116 bumper
120 wing 122 lateral direction
124 inner edge
126 outside edge
130 vertical pivot axis
132 elongated rod
134 hinge member
136 reinforcing member
140 upper section
142 lowermost edge (of the upper section)
144 main bottom part (of the upper section)
146 upper part (of the upper section)
150 bottom section
152 first horizontal pivot axis
154 guide slot
155 follower
156 guide slot
157 follower
158 washer
159 washer
160 first subsection
162 lowermost edge (first subsection)
170 second subsection
172 second horizontal pivot axis
180 upper portion (of second subsection)
182 lowermost edge (upper portion)
190 bottom portion (of second subsection)
192 lowermost edge (bottom portion)
194 segment
196 disk
198 articulated link
200 actuator
202 outer pivot
204 inner pivot
206 horizontal beam
220 spring
230 spring
232 upper bracket
234 shaft
236 bottom bracket
240 spring
250 upper portion
260 bottom portion
262 lowermost edge (of the bottom portion)
270 front surface (of central support)
300 top flexible band (wing)
302 top flexible band (central support)
310 lateral strip
320 spring (central support)
330 spring (central support)

The invention claimed is:

1. A scraping device for cleaning a roadway surface, the scraping device having a right side, a left side, and a lowermost edge and forming an overall front surface, the scraping device including:

a support and two opposing lateral wings forming the right and left sides of the scraping device, each wing extending in a lateral direction between an inner edge and an outer edge and having a front surface, the inner edge of each wing being configured to pivot about a vertical pivot axis that is shared with or distinct from the vertical axis of the other wing, each wing including:

an upper section through which the wing is attached to the vertical pivot axis, the upper section having a lowermost edge;

a bottom section pivotable relative to the upper section about a first pivot axis, which first pivot axis is located at a position that is adjacent to the vertical pivot axis and also adjacent to the lowermost edge of the upper section, the upper and bottom sections of each wing being in a sliding engagement with one another; and a first force-generating mechanism comprising at least one compression spring mounted between the upper section and the bottom section to exert a first return force urging the bottom section downwards with reference to the upper section; and at least one actuator mounted between the support and the upper section of each wing to pivot the wing about the vertical pivot axis;

wherein the bottom section of each wing includes:

a first subsection through which the bottom section is attached to the upper section, the first subsection having a lowermost edge; and a second subsection positioned below the first subsection and pivotable with respect to the first subsection about a second pivot axis extending along the lowermost edge of the first subsection; and wherein the second subsection of each wing includes:

an upper portion through which the second subsection is attached to the first subsection, the upper portion having a lowermost edge; and a bottom portion mainly projecting under the lowermost edge of the upper portion and movable while remaining parallel to the upper portion, the bottom portion having a lowermost edge forming a corresponding portion of the lowermost edge of the scraping device.

2. The scraping device as defined in claim 1, wherein the support is a central support located entirely at a rear of the vertical pivot axis.

3. The scraping device as defined in claim 2, wherein each wing includes at least one guide slot cooperating with at least one corresponding follower located on the upper section and the bottom section.

4. The scraping device as defined in claim 1, wherein each wing includes:

a second force-generating mechanism mounted between the first subsection and the upper portion of the second subsection to exert a second return force urging the second subsection back to a working position following a frontal impact of the lowermost edge of the scraping device with an obstacle on the roadway surface; and a third force-generating mechanism mounted between the upper portion and the bottom portion of the second subsection to exert a third return force so that the lowermost edge of the bottom portion can follow an irregularity of the roadway surface.

5. The scraping device as defined in claim 4, wherein the bottom portion of the second subsection of each wing is subdivided into at least two juxtaposed segments.

6. The scraping device as defined in claim 1, wherein each wing includes at least two spaced-apart guide slots provided on the upper section and cooperating with corresponding followers mounted on the bottom section.

7. The scraping device as defined in claim 1, wherein both wings have the same vertical pivot axis, the overall front surface of the scraping device being formed by the adjoined front surfaces of the two wings.

8. The scraping device as defined in claim 1, wherein:

the support comprises a central support, the central support positioned between the two wings and comprising a front surface with a width smaller than that of each wing;

the vertical pivot axis of each wing is distinct from the vertical axis of the other wing and is provided on a corresponding lateral side of the central support; and the overall front surface of the scraping device is formed by the adjoined front surfaces of the central support and of the two wings.

9. A scraping device for cleaning a roadway surface, the scraping device having a right side, a left side, and a lowermost edge, the scraping device including:

a support;

two opposing lateral wings forming the right and left sides of the scraping device, each wing extending in a lateral direction between an inner edge and an outer edge, and the inner edge of both wings being configured to pivot about a common vertical pivot axis, each wing including:

an upper section through which the wing is pivotally attached to the vertical pivot axis, the upper section having a lowermost edge;

a bottom section pivotable relative to the upper section about a first pivot axis, which first pivot axis is located at a position that is adjacent to the vertical pivot axis and also adjacent to the lowermost edge of the upper section, the bottom section of each wing including:

a first subsection through which the bottom section is pivotally attached to the upper section, the first subsection remaining parallel to a corresponding portion of the upper section when the bottom section is pivoted about the first pivot axis, the first subsection having a lowermost edge; and a second subsection positioned below the first subsection; and a first force-generating mechanism comprising at least one compression spring mounted between the upper section and the bottom section to exert a first return force urging the bottom section downwards with reference to the upper section; and at least one actuator mounted between the support and the upper section of each wing to pivot the wing about the vertical pivot axis;

wherein the second subsection is pivotable with respect to the first subsection about a second pivot axis extending along the lowermost edge of the first subsection; and wherein the second subsection of each wing includes:

an upper portion through which the second subsection is attached to the first subsection, the upper portion having a lowermost edge; and a bottom portion mainly projecting under the lowermost edge of the upper portion and movable while remaining parallel to the upper portion, the bottom portion having a lowermost edge forming a corresponding portion of the lowermost edge of the scraping device.

10. The scraping device as defined in claim 9, wherein the support is a central support located entirely at a rear of the vertical pivot axis.

11. The scraping device as defined in claim 10, wherein each wing includes at least one guide slot cooperating with at least one corresponding follower located on the upper section and the bottom section.

12. The scraping device as defined in claim 9, wherein each wing includes:

a second force-generating mechanism mounted between the first subsection and the upper portion of the second subsection to exert a second return force urging the second subsection back to a working position following a frontal impact of the lowermost edge of the scraping device with an obstacle on the roadway surface; and a third force-generating mechanism mounted between the upper portion and the bottom portion of the second subsection to exert a third return force so that the lowermost edge of the bottom portion can follow an irregularity of the roadway surface.

13. The scraping device as defined in claim 12, wherein the bottom portion of the second subsection of each wing is subdivided into at least two juxtaposed segments.

14. The scraping device as defined in claim 9, wherein each wing includes at least two spaced-apart guide slots provided on the upper section and cooperating with corresponding followers mounted on the bottom section.

15. The scraping device as defined in claim 9, wherein adjoined front surfaces of the two wings form an overall front surface of the scraping device.

16. The scraping device as defined in claim 9, wherein the common vertical pivot axis is provided on the support, and wherein the support comprises a front surface with a width smaller than that of each wing, and wherein adjoined front surfaces of the support and of the two wings form an overall front surface of the scraping device.

17. A scraping device for cleaning a roadway surface, the scraping device having a right side, a left side, and a lowermost edge, the scraping device including:

a support having a front surface;

two opposing lateral wings forming the right and left sides of the scraping device, each wing having an inner edge, an outer edge, and a front surface, the inner edge of each wing being configured to pivot about a corresponding vertical pivot axis provided on a respective lateral side of the support, the front surfaces of the support and that of the two opposing wings forming together a front surface of the scraping device, each wing including:

an upper section through which the wing is attached to the corresponding vertical pivot axis, the upper section having a lowermost edge;

a bottom section pivotable relative to the upper section about a first pivot axis, which first pivot axis is located at a position that is adjacent to the vertical pivot axis and also adjacent to the lowermost edge of the upper section; and a first force-generating mechanism comprising at least one compression spring mounted between the upper section and the bottom section to exert a first return force urging the bottom section downwards with reference to the upper section; and at least one actuator mounted between the support and the upper section of each wing to pivot the wing about the corresponding vertical pivot axis;

wherein the bottom section of each wing includes:

a first subsection through which the bottom section is attached to the upper section, the first subsection having a lowermost edge; and a second subsection positioned below the first subsection and pivotable with respect to the first subsection about a second pivot axis extending along the lowermost edge of the first subsection; and wherein the second subsection of each wing includes:

an upper portion through which the second subsection is attached to the first subsection, the upper portion having a lowermost edge; and a bottom portion mainly projecting under the lowermost edge of the upper portion and movable while remaining parallel to the upper portion, the bottom portion having a lowermost edge forming a corresponding portion of the lowermost edge of the scraping device.

18. The scraping device as defined in claim 17, wherein the support is a central support located entirely at a rear of the vertical pivot axis.

19. The scraping device as defined in claim 17, wherein the bottom portion of the second subsection of each wing is subdivided into at least two juxtaposed segments.

20. The scraping device as defined in claim 17, wherein each wing includes:

a second force-generating mechanism mounted between the first subsection and the upper portion of the second subsection to exert a second return force urging the second subsection back to a working position following a frontal impact of the lowermost edge of the scraping device with an obstacle on the roadway surface; and a third force-generating mechanism mounted between the upper portion and the bottom portion of the second subsection to exert a third return force so that the lowermost edge of the bottom portion can follow an irregularity of the roadway surface.

* * * * *